US006002312A

United States Patent [19]

Dittmann et al.

[11] Patent Number: 6,002,312

[45] Date of Patent: Dec. 14, 1999

[54] ELECTROMAGNETIC RELAY

[75] Inventors: Michael Dittmann; Jens Heinrich, both of Berlin; Heinz Stadler, München, all of Germany

[73] Assignee: Siemens Aktiengesellschaft, Munich, Germany

[21] Appl. No.: 09/142,155

[22] PCT Filed: Apr. 3, 1997

[86] PCT No.: PCT/DE97/00686

§ 371 Date: Sep. 2, 1998

§ 102(e) Date: Sep. 2, 1998

[87] PCT Pub. No.: WO97/39467

PCT Pub. Date: Oct. 23, 1997

[30] Foreign Application Priority Data

Apr. 17, 1996 [DE] Germany ..... 195 15 185

[51] Int. Cl.[6] ..... H01H 51/22

[52] U.S. Cl. ..... 335/78; 336/96; 335/260; 335/278

[58] Field of Search ..... 335/78, 86, 128, 335/260, 278; 336/96

[56] References Cited

U.S. PATENT DOCUMENTS

| | | | |
|---|---|---|---|
| 4,185,163 | 1/1980 | Schedele | 174/52 S |
| 4,307,362 | 12/1981 | Kobler et al. | 335/202 |
| 4,717,901 | 1/1988 | Autenrieth et al. | 336/83 |
| 4,985,984 | 1/1991 | Umezaki | 29/602.1 |
| 5,167,066 | 12/1992 | Dittman et al. | 335/78 |
| 5,440,285 | 8/1995 | Nakanishi et al. | 335/78 |
| 5,617,066 | 4/1997 | Dittmann et al. | 335/78 |

FOREIGN PATENT DOCUMENTS

| | | |
|---|---|---|
| 0 581 958 A1 | 9/1994 | European Pat. Off. . |
| 0 727 803 A1 | 8/1996 | European Pat. Off. . |
| 2 352 469 | 12/1977 | France . |
| 1 222 574 | 11/1966 | Germany . |
| 44 08 980 A1 | 9/1994 | Germany . |
| 295 21 012 U1 | 9/1996 | Germany . |
| WO 94/13002 | 9/1994 | WIPO . |
| WO 94/22156 | 9/1994 | WIPO . |

*Primary Examiner*—Lincoln Donovan
*Assistant Examiner*—Tuyen T. Nguyen
*Attorney, Agent, or Firm*—Hill & Simpson

[57] ABSTRACT

An electromagnetic relay has a base with a contact arrangement and a rocker armature mounted on the base. Above the base, a magnet system with a coil, a core and two yokes is provided, this system working together with the rocker armature. At least the coil with the core is embedded in the insulating material of a basic body which surrounds the base in box-type fashion with side walls that are integrally formed downwardly, and forms a sealed contact chamber. By means of the basic body surrounding the coil, a high insulation strength of the relay between the coil and the contact system is ensured, as is a high stability of the construction.

11 Claims, 3 Drawing Sheets

ELECTROMAGNETIC RELAY

BACKGROUND OF THE INVENTION

The invention relates to an electromagnetic relay having a base made of insulating material, whose floor side defines a basic plane and in which are anchored bearers for fixed contacts, as well as contact terminal pins, an armature arranged pivotably over the base, a coil arranged above the armature, with an axis parallel to the basic plane, a core arranged axially in the coil, with yokes directed downward at both ends, perpendicular to the basic plane, which form working air gaps with the armature, and a contact spring arrangement connected with the armature, which works together with the fixed contacts of the base, corresponding to the armature movement.

A relay of the type named above is specified in WO 94/22156. corresponding to U.S. Pat. No. 5,617,066 incorporated herein by reference. There a coil body is set immediately on the base, which body, in addition to the coil winding and the core, also bears the yokes and a permanent magnet, and which is connected directly with the base in side areas. A cap covering the coil body is connected with the base for the formation of a closed housing. This known construction is designed for conventional solder connection technology; however, the connection structure of base and coil body is not designed for stronger mechanical or thermal loads. However, since surface mounting technique (SMT) and connection technology with press-fit pins are also increasingly desired for the equipping of circuit boards in addition to conventional contacting via solder terminal pins, relays should be constructed so as to be able to withstand, as much as possible, the mechanical or, respectively, thermal loads that occur with these technologies, without worsening of the precisely set characteristics of the relay. In addition, from WO 94/13002 a relay of similar construction is known in which a coil block and a terminal arrangement are together extrusion-coated with insulating material, creating a one-piece basic body unit. An armature with movable contact springs is set on this basic body unit, and the relay thus formed is closed with a covering cap. Since, however, in this case the basic body unit forms the lower part of the housing with respect to the terminal plane, and the armature is located in the upper region, the contact terminals must be guided downward laterally next to the coil. The terminals thereby not only become very long, but also require additional space, which, together with the required intermediate insulating walls, increases the width of the relay. Moreover, the solder terminal lugs located there cannot be replaced with other terminals, e.g. press-fit posts, without a modification of the construction.

SUMMARY OF THE INVENTION

An object of the present invention is to construct a relay design of the type named above with such a construction that the insulation strength between the magnetic circuit and the winding is improved in the simplest way possible, and at the same time the mechanical stability of the relay is increased with the smallest possible volume; different terminal technologies, in particular also SMT terminals and press-fit posts, should thereby also be usable without modification of the remaining construction.

According to the invention, this object is achieved in the named relay construction in that a basic body is designed by means of sheathing of the coil on all sides with insulating material, which together with the base forms a cuboidal housing, whereby the coil together with the core is embedded in the upper region of the basic body, and is insulated downward by means of a separating wall, and whereby the basic body downwardly comprises side walls integrally formed all around, which surround the base in box-type fashion and form a closed switching chamber therewith. By means of the basic body produced according to the invention by means of embedding, preferably by extrusion coating of the coil with insulating material there results a high rigidity and stability of the relay construction. The adjustments set in the manufacturing are in this way securely maintained, even if mechanical or thermal loads act from outside on the relay housing formed by the basic body and base.

This stable construction is particularly advantageous if the basic body comprises on both sides of the armature a shoulder under which are located the contact terminal pins, respectively arranged in a row, and which is suited as a support region for these terminal pins as needed. It can thereby also be advantageous to additionally include the two yokes in the extrusion coating. If the system is a polarized system, an associated permanent magnet can optionally be subsequently plugged into a corresponding recess, or can also be embedded during the manufacturing of the basic body.

In addition, in a simple embodiment of the relay it can be provided that solder terminal pins are bent downward from a circuit board injected in the base. The stable construction of the invention is, however, particularly effective if terminal pins are used that extend from the base perpendicularly upward, up to the respective support region of the basic body. In order to avoid an overdetermination during the manufacturing, it is usefully provided that the terminal pins are respectively arranged in grooves of the basic body in the support region, and are fixed there by means of hardenable sealing compound. It is thus possible that after the assembly of the armature on the base and the precise setting thereby carried out by the contact spacings, the basic body with the magnet system can be pushed onto the base until the armature lies precisely on the magnet system, or, respectively, has achieved the predetermined air gaps to the yokes. By means of pouring in of adhesive material or, respectively, sealing compound, the basic body can then be connected in sealing fashion with the base, whereby the terminal pins are cast and fixed in the mentioned grooves in a preceding or simultaneous operational step. In this way, there results a tight and stable switching chamber that is insulated against the coil. This switching chamber also has a very small air volume in comparison with relays of similar construction, because the coil chamber is not also included. This is particularly advantageous given a strong heat effect, as for example in the soldering of the relay, in particular given reflow soldering of SMT terminals.

In the following, the invention is explained in more detail in relation to embodiments, on the basis of the drawings.

DESCRIPTION OF THE PREFERRED EMBODIMENTS

Figure 1:
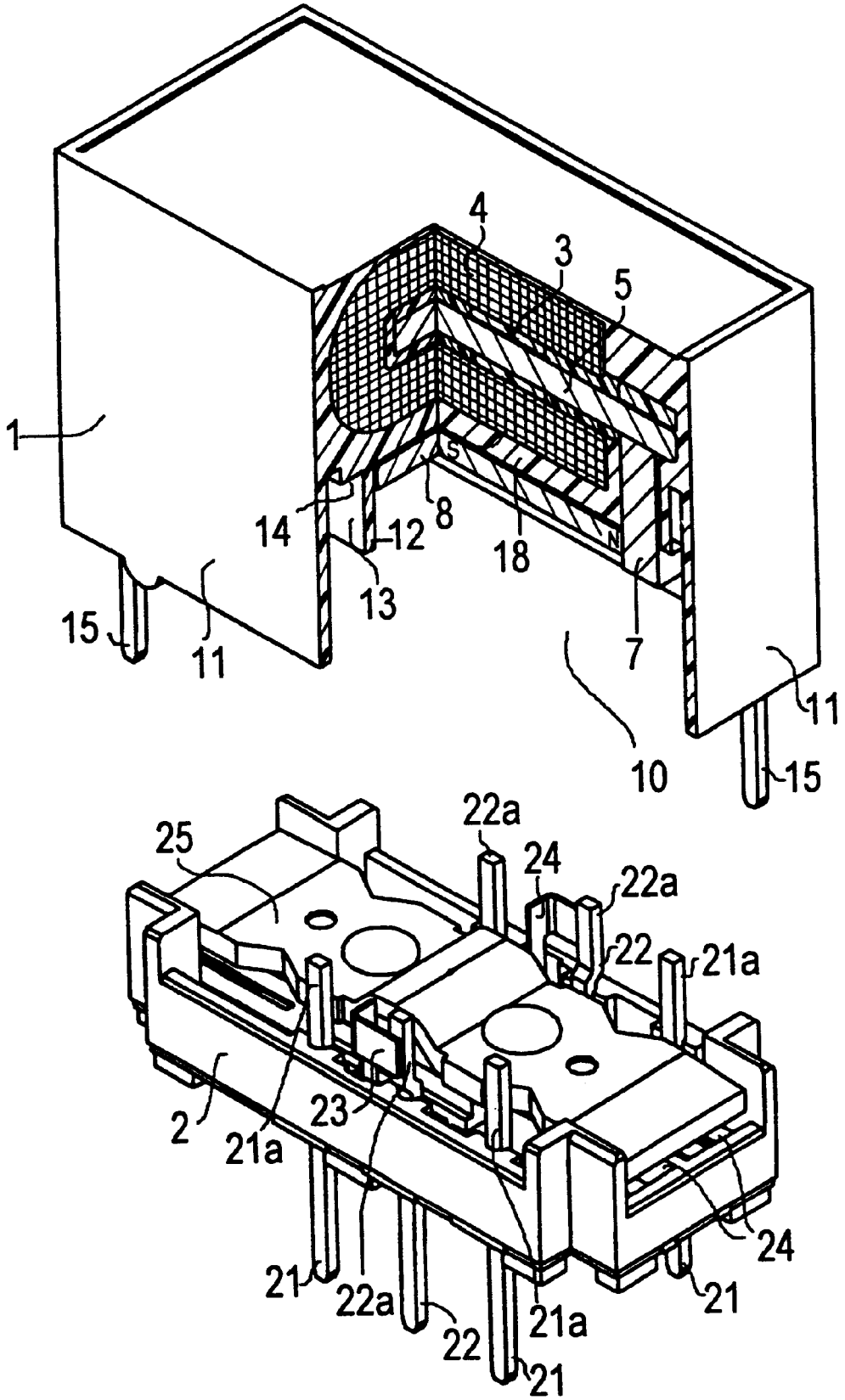
FIG. 1 shows a relay according to the invention illustrating the assembly of the basic body with magnet system (partially sectioned) to the base equipped with the armature.
Figure 2:
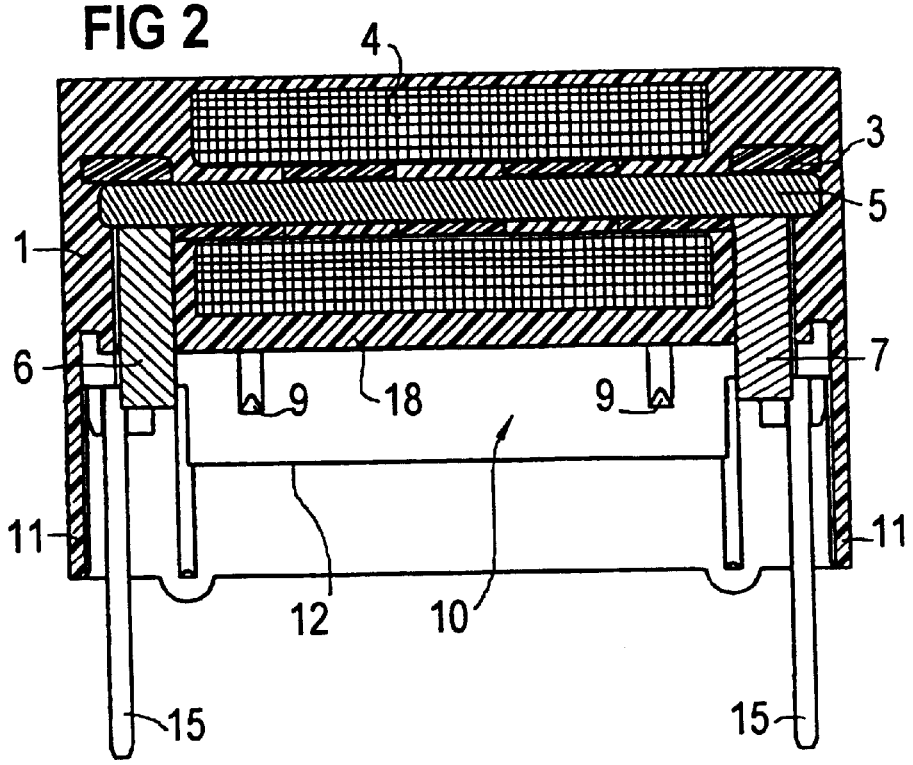
FIG. 2 shows a longitudinal section through a basic body.
Figure 3:
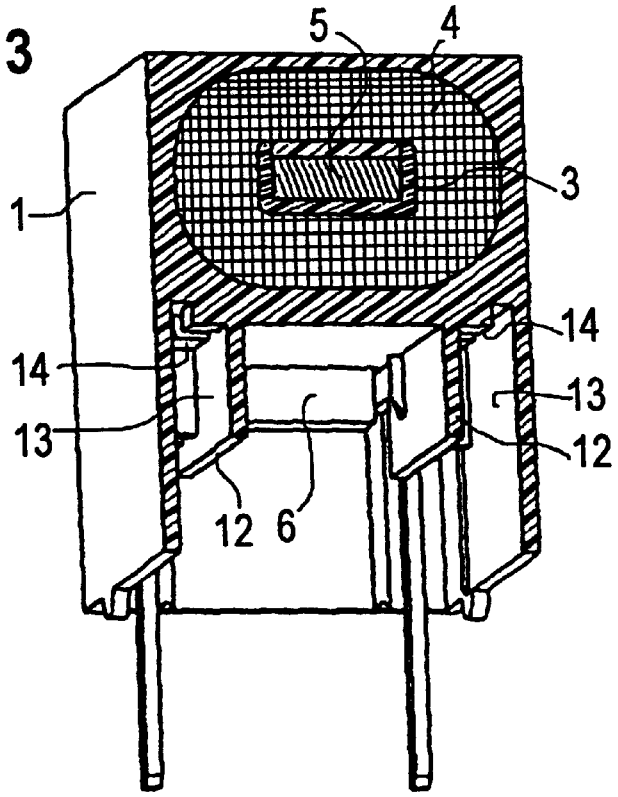
FIG. 3 shows a perspective view of a basic body, in cross-section.

The polarized relay shown in FIGS. 1 to 3 has essentially two assemblies, namely a basic body 1 that contains a magnet system and a base 2 with an armature and a contact arrangement. The basic body 1 outwardly has an essentially cuboidal shape, formed by means of an extrusion coating of the magnet system. This magnet system contains a coil formed of a coil body 3 and a winding 4. Moreover, a rod-shaped core 5 is arranged in an axial through-opening of the coil body. The ends of the core 5, respectively protruding from the coil body 3, are coupled with two yokes 6 and 7, which in the examples of FIGS. 1 to 3 are likewise embedded in the material of the basic body 1. Insofar as in the drawings the coil body comprises recesses filled with the material of the basic body 1, these are interruptions, due to the manufacturing, of this coil body constructive shape; however, a conventional coil body could also be used, with a continuous tube of insulating material as a winding bearer. In any case, however, the plastic material of the basic body 1 surrounds the coil winding on all sides to form a pocket, so that a good insulation is ensured against the metal parts of the magnetic circuit, and above all also against the contact elements, by means of a separating wall 18 of the pocket on the underside of the coil. In addition, the magnet system contains a permanent magnet 8, shown in FIG. 1, which is magnetized in three-pole fashion and is plugged between the two yokes 6 and 7 in such a way that its two end poles of the same polarity (N) are respectively coupled to one of the yokes 6 or, respectively, 7. In this example, the permanent magnet can be fastened with squeezing ribs 9 of the basic body. However, other fastening possibilities are also conceivable.

In addition, the basic body 1 has side walls 11 integrally formed toward the underside and running around circumferentially, with which the basic body 1 can be plugged onto the base 2. The side walls 11 thereby grasp the base 2 in box-type fashion, and form a sealed switching chamber 10 between the magnet system and the base. Moreover, in the interior of the basic body 1 two longitudinal webs 12 are provided parallel to the coil axis or, respectively, to the longitudinal sides of the basic body. Together with the parallel side walls 11, these respectively form a longitudinal groove 13 with a support surface 14 on their upper side, which, as needed, can serve for support and stabilization of the contact terminals specified below.

In the base 2, two pairs of fixed contact terminals 21 are anchored, which are connected with fixed contacts (not shown) via a circuit board (also not shown) embedded in the base. Moreover, two mid-position contact terminals 22 located opposite one another are also anchored, which are connected with mid-position contact springs 24 via bearing strips 23.

These mid-position contact springs 24 are connected in a known way with an armature 25, held in the mount in a manner likewise known, via the bearing strips 23.

Figure 4:
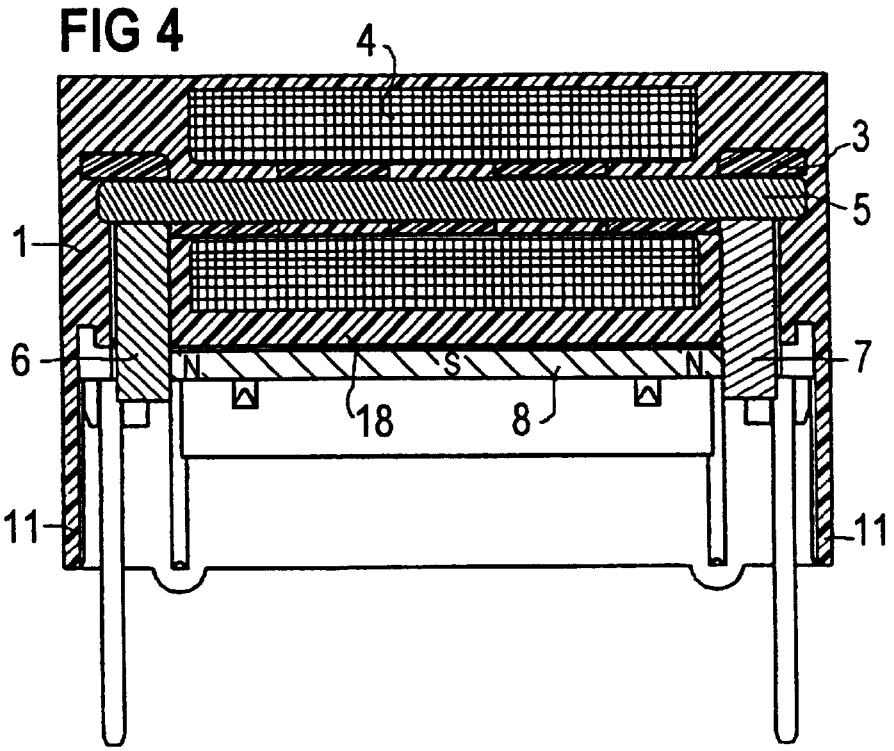
FIG. 4 shows a basic body in longitudinal section corresponding to FIG. 2, but with an additionally embedded permanent magnet.
Figure 5:
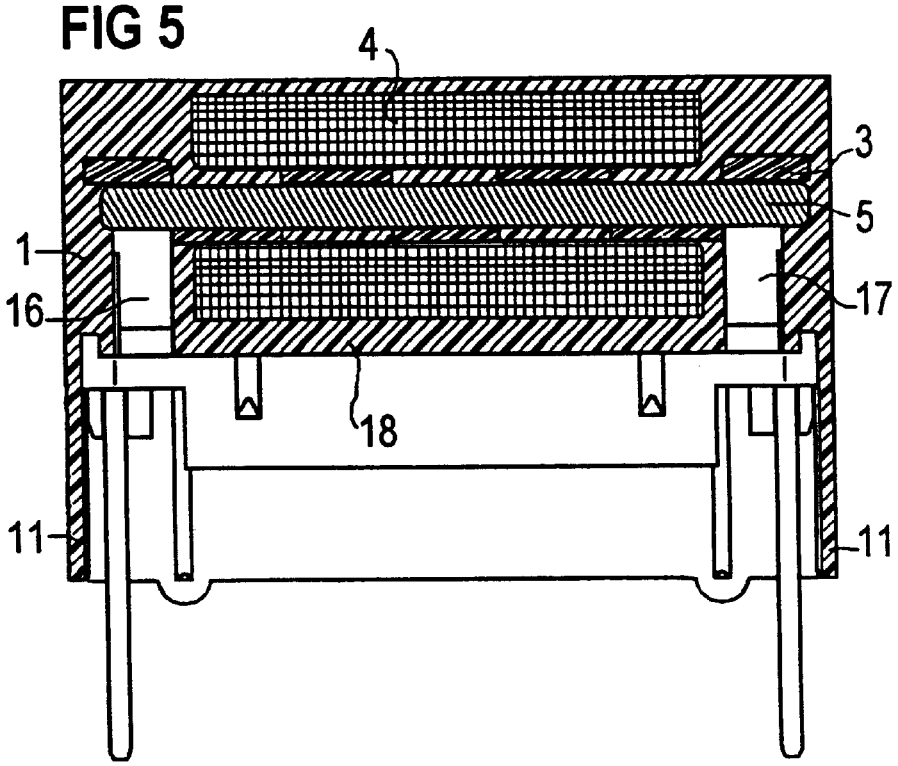
FIG. 5 shows a longitudinal section, corresponding to FIG. 2, of a basic body, with recesses for the yokes.

The terminals 21 and 22 respectively have support segments 21*a* or, respectively, 22*a* that project over the upper side of the base, which segments come to lie in the groove 13 between the respective side wall 11 and the respective longitudinal web 12 when the basic body 1 is set on the base 2. They can, for example, either be supported immediately on the support surface 14 or in the interior of the groove 13. For tolerance compensation, it is however more advantageous to fill these grooves 13 respectively with sealing compound after assembly, which compound reliably stabilizes and supports the terminal elements. For the rest, the construction of the relay, except for the new basic body shape, is largely similar to the relay according to WO 94/22156 (named above) with respect to its functioning, so that no further description is required here. FIGS. 4 and 5 show modifications of the basic body, in the same manner of representation as in FIG. 2. Thus, FIG. 4 shows an embodiment in which the permanent magnet 8 is already embedded with the yokes 6 and 7 during the manufacturing of the basic body 1. FIG. 5 shows another embodiment in which the embedding of the basic body 1 comprises only the coil with coil body 3 and winding 4, as well as the core 5, while for the yokes, specific plug pockets 16 and 17 are left open, into which they can be subsequently plugged. The permanent magnet 8 is also in this case subsequently plugged and is fixed by means of squeezing ribs 9, as already shown on the basis of FIG. 2.

Further modifications of the relay are possible. Thus, in particular the terminals 21 and 22 can be varied according to the type of terminal technology used. In the representation in FIG. 1, press-fit posts are used, which are pressed under high pressure into contact holes of a circuit board, thereby resulting in a solderless connection. In this case, the support of the support segments 21*a* and 22*a* in the basic body is particularly important, since in this way the press-fit forces can be communicated to the terminals via the basic body.

The relay construction can however also be used for other terminal technologies. Thus, instead of the press-fit posts shown, normal solder terminal pins or laterally bent-off SMT terminal lugs can also be provided. In these cases, the support in the basic body is not required to the same extent. Nonetheless, it can be provided for the stabilization of the overall construction. However, in the case of these terminal techniques it is also possible to construct the support segments 21*a* or, respectively, 22*a* (shown in FIG. 1) shorter, or, designed, to omit them. The coil terminal pins 15, also anchored in the basic body, are always fashioned corresponding to the contact terminal elements.

Finally, it should be noted that the invention is not limited to polarized relays according to the embodiment. Another polarized magnet system, or a known neutral system, can also be housed in the basic body 1 and can actuate the contact arrangement.

Although various minor changes and modifications might be proposed by those skilled in the art, it will be understood that our wish is to include within the claims of the patent warranted hereon all such changes and modifications as reasonably come within our contribution to the art.

We claim as our invention:

1. An electromagnetic relay, comprising:

a base made of insulating material having a floor side defining a basic plane and in which are anchored bearers for fixed contacts, as well as contact terminal pins;

an armature arranged pivotably over the base;

a coil arranged above the armature with an axis parallel to the basic plane;

a core arranged axially in the coil with two yokes directed downward at both ends, perpendicular to the basic plane, and which form working air gaps with the armature;

a contact spring arrangement connected with the armature which works together with the fixed contacts of the base corresponding to armature movement; and a one piece basic body having integral internal material forming an insulated material sheathing pocket completely surrounding said coil and shaped to conform to a shape of said coil and which forms together with the base a cuboidal housing, the coil together with the core being embedded in an upper region of the basic body in said pocket and being insulated below by means of a separating wall at a bottom of the pocket and formed by the integral material of the basic body, and the basic body comprising circumferentially integrally formed side walls which surround the base in box-type fashion and form a closed switching chamber therewith.

2. The relay according to claim 1 wherein the basic body comprises on both sides of the armature a shoulder under which are located the contact terminal pins arranged in a row, and which forms a support region for said terminal pins.

3. The relay according to claim 1, wherein the two yokes are embedded in the insulating material of the basic body.

4. The relay according to claim 3 wherein a rod-shaped permanent magnet, magnetized in three-pole fashion, is embedded in the insulating material of the basic body together with the coil and the two yokes.

5. The relay according to claim 1 wherein the contact spring arrangement comprises two contact springs arranged in one plane, each contact spring respectively comprising a flexible terminal segment, led out laterally in a bearing region of the armature, which is designed as a rocker, said flexible terminal segment being respectively connected with a terminal pin anchored in the base.

6. The relay according to claim 1 wherein interconnects of a pre-stamped board which are embedded in the base in one plane respectively form bearers for the fixed contacts, terminal segments for the contact springs, and terminal pins guided perpendicularly downward.

7. The relay according to claim 1, wherein interconnects embedded in the base in one plane respectively form bearers for the fixed contacts, terminal pins perpendicular to the basic plane and penetrating through the plane of the interconnects being connected with said interconnects, and upper ends of the pins being supported on the shoulder of the basic body.

8. The relay according to claim 7 wherein the upper ends of the terminal pins which emerge at an underside of the base being formed into press-fit posts.

9. The relay according to claim 7 wherein the ends of the terminal pins which emerge at the underside of the base being formed into SMT terminal lugs.

10. The relay according to claim 7 wherein the upper-side end segments of the terminal pins protrude, in a region of the basic body shoulder into a downwardly open groove, and are fixed therein by a hardened sealing compound.

11. An electromagnetic relay, comprising:

a base made of insulating material having a floor side defining a basic plane and in which are anchored bearers for fixed contacts, as well as contact terminal pins;

an armature arranged over the base;

a coil arranged above the armature with an axis parallel to the basic plane;

a core arranged axially in the coil with a yoke structure directed perpendicular to the basic plane and which form a working air gap structure with the armature;

a contact spring arrangement connected with the armature which works together with the fixed contacts of the base corresponding to armature movement; and a basic body having integral internal portions forming an insulated material sheathing pocket completely surrounding and shaped to conform to a shape of said coil, the coil together with the core being embedded in an upper region of the basic body in said pocket and being insulated below by an insulation structure which is a lower wall of the pocket, and the basic body comprising circumferentially integrally formed side walls which surround the base in box-type fashion and form a closed switching chamber therewith.

* * * * *